US005637957A

United States Patent [19]

Konishi et al.

[11] Patent Number: 5,637,957

[45] Date of Patent: Jun. 10, 1997

[54] CATHODE-ANODE SPACER COMPRISING A PROJECTION OF A LENGTH LIMITED RELATIVE TO ITS DISTANCE TO THE CATHODE

[75] Inventors: Takayoshi Konishi, Tokyo; Osamu Yamamoto, Kyoto, both of Japan

[73] Assignee: NEC Corporation, Tokyo, Japan

[21] Appl. No.: 617,602

[22] Filed: Mar. 19, 1996

[30] Foreign Application Priority Data

Mar. 20, 1995 [JP] Japan ..... 7-060717
Mar. 6, 1996 [JP] Japan ..... 8-048608

[51] Int. Cl.[6] ..... H01J 1/88

[52] U.S. Cl. ..... 313/495; 313/292; 313/250; 313/231.11

[58] Field of Search ..... 313/495, 309, 313/351, 292, 250, 257, 258, 268, 231.11

[56] References Cited

U.S. PATENT DOCUMENTS 2,063,188 12/1936 Parker et al. .

FOREIGN PATENT DOCUMENTS 58-106745 6/1983 Japan .
2-061971 3/1990 Japan .
4-255642 9/1992 Japan .
4-280037 10/1992 Japan .

OTHER PUBLICATIONS

By Wetzer, J.M. et al., "The Effect of Insulator Charging on Breadown and Consitioning", *IEEE Transactions on Electrical Insulation,* vol. 28, No. 4, Aug. 1993, pp. 681–691.

By Yamamoto, O. et al., "Monte Carlo Simulation of Surface Charge on Angled Insulators in Vacuum", *IEEE Transactions on Electrical Insulation,* vol. 28, No. 4, Aug. 1993, pp. 706–712.

*Primary Examiner*—Sandra L. O'Shea
*Assistant Examiner*—Vip Patel
*Attorney, Agent, or Firm*—Young & Thompson

[57] ABSTRACT

For use in vacuum between a cathode (21) and an anode (23) with avoidance of surface flashover resulting from a voltage supplied between the cathode and the anode, a dielectric spacer (25) has a side surface and a projection (27) protruded perpendicularly of the side surface. The projection has a length of projection from the side surface, a cathode side end having a cathode distance relative to the cathode, an anode side end, and a thickness having a center plane between the cathode and the anode side ends and nearer to the cathode than to the anode, a ratio of the length of projection to the cathode distance being not less than 0.4. The cathode comprises no protrusion in a face to face relation to the anode side end. It is possible to use the dielectric spacer between two electrodes supplied with an AC voltage.

5 Claims, 9 Drawing Sheets

$V_1$ : INITIAL DISCHARGE VOLTAGE OF COLUMN-SHAPED CERAMIC WITHOUT ANY PROJECTION $V_2$ : INITIAL DISCHARGE VOLTAGE OF COLUMN-SHAPED CERAMIC WITH PROJECTION a : DISTANCE BETWEEN CATHODE AND SURFACE OF CATHODE SIDE OF PROJECTION NEAREST CATHODE b : PROTRUDING LENGTH OF PROJECTION NEAREST CATHODE

CATHODE-ANODE SPACER COMPRISING A PROJECTION OF A LENGTH LIMITED RELATIVE TO ITS DISTANCE TO THE CATHODE

BACKGROUND OF THE INVENTION

This invention relates to an insulator or dielectric spacer for use in vacuum between a cathode and an anode, which may be two electrodes supplied either with an AC or DC voltage.

Although semiconductor devices are widely used, vacuum tubes are still indispensable. In such a vacuum tube, a voltage of a high tension, such as 100 kV, is supplied between a cathode and an anode with a dielectric spacer used to insulate the cathode and the anode from each other. The voltage develops an electric field of a strong field intensity, such as 100 kV/cm, along a spacer surface of the dielectric spacer. Such a high voltage and a strong electric field give rise to surface flashover or to objectionable surface leakage.

Various designs are in use to prevent the surface flashover from taking place. Examples are disclosed in Japanese Patent Prepublications (A) Nos. 106,745 of 1983, 255,642 of 1992, and 280,037 of 1992. The surface flashover is theoretically discussed in a paper contributed by J. M. Wetzer and another to the IEEE Transactions on Electrical Insulation, Volume 28, No. 4 (August 1993), pages 681 to 691, under the title of "The Effect of Insulator Charging on Breakdown and Conditioning" and a paper contributed by O. Yamamoto, one of two present joint inventors, and three others to the IEEE Transactions on Electrical Insulation, the same issue, pages 706 to 712, under the title of "Monte Carlo Simulation of Surface Charge on Angled Insulators in Vacuum".

In the manner which will later be described in greater detail, these conventional dielectric spacers are still objectionable. For example, a conventional dielectric spacer is bulky, is complicated in its shape, is expensive to manufacture, or does not have a well-developed design mechanism.

SUMMARY OF THE INVENTION

It is consequently an object of the present invention to provide a dielectric spacer which is for use in vacuum between two electrodes, such as a cathode and an anode, and which is capable of withstanding a voltage supplied between the electrodes.

It is another object of this invention to provide a dielectric spacer which is of the type described and is compact.

It is still another object of this invention to provide a dielectric spacer which is of the type described and is simple in shape.

It is yet another object of this invention to provide a dielectric spacer which is of the type described and is inexpensive to manufacture.

It is a further object of this invention to provide a dielectric spacer which is of the type described and for which design mechanism is well established.

Other objects of this invention will become clear as the description proceeds.

In accordance with an aspect of this invention, there is provided a dielectric spacer which is for use in vacuum between a cathode and an anode with avoidance of surface flashover resulting from a voltage supplied between the cathode and the anode and has a side spacer surface and a projection protruded perpendicularly of the side spacer surface, wherein the projection has a length of projection from the side spacer surface, a cathode side end and having a cathode distance relative to the cathode, an anode side end, and a thickness having a center plane between the cathode side ends and the anode side ends and nearer to the cathode than to the anode, a ratio of the length of projection to the cathode distance being not less than 0.4, the cathode comprising no protrusion in a face to face relation to the anode side end.

In accordance with another aspect of this invention, there is provided a dielectric spacer which is for use in vacuum between first and second electrodes with avoidance of surface flashover resulting from an AC voltage supplied between the first and the second electrodes, the dielectric spacer having a side spacer surface and first and second projections protruded perpendicularly of the side spacer surface, wherein each of the first and the second projections has a length of projection from the side spacer surface, a thickness having a center plane nearer to one of the first and the second electrodes than to the other of the first and the second electrodes, and a side projection surface parallel to the center plane to have a projection distance relative to the one of first and second electrodes, a ratio of the length of projection to the projection distance being not less than 0.4.

DESCRIPTION OF THE PREFERRED EMBODIMENT

Referring to FIGS. 1, 2, 3, 4, and 5, conventional dielectric spacers will first be described in order to facilitate an understanding of this invention.

Figure 1:
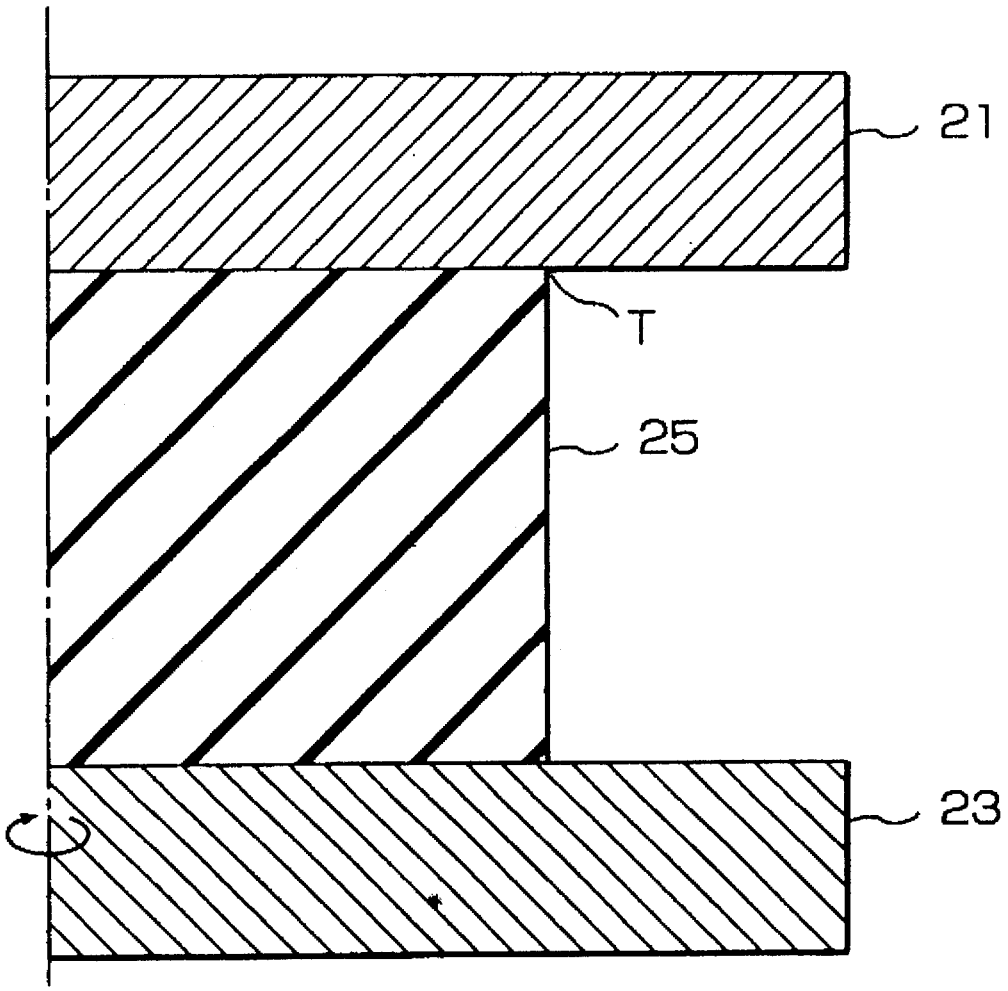
PRIOR ART FIG. 1
FIG. 1 is a partial axial sectional view of a first conventional dielectric spacer in vacuum between a cathode and an anode.

Referring to FIG. 1, in the manner which will later be described more in detail, a dielectric spacer 25 is used between a cathode 21 and an anode 23, and is made of alumina ceramic. The dielectric spacer 25 maintains the cathode 21 and the anode 23 apart.

The dielectric spacer 25 has a smooth cylindrical side surface perpendicular to both the cathode 21 surface and the anode 23 surface. Shapes of the cathode 21, the anode 23, and the dielectric spacer 25 have rotational symmetry. Surface flashover is apt to occur along the side surface in this kind of dielectric spacer 25.

In this case, the cylinder-shaped dielectric spacer is frequently used as a vacuum vessel, the inside of the spacer is maintained at vacuum, and the outside of the spacer is at atmospheric pressure. The outside of the spacer is molded or is made of structure with resistance to voltage, and consequently, discharge is restrained at the outside of the vacuum.

Figure 2:
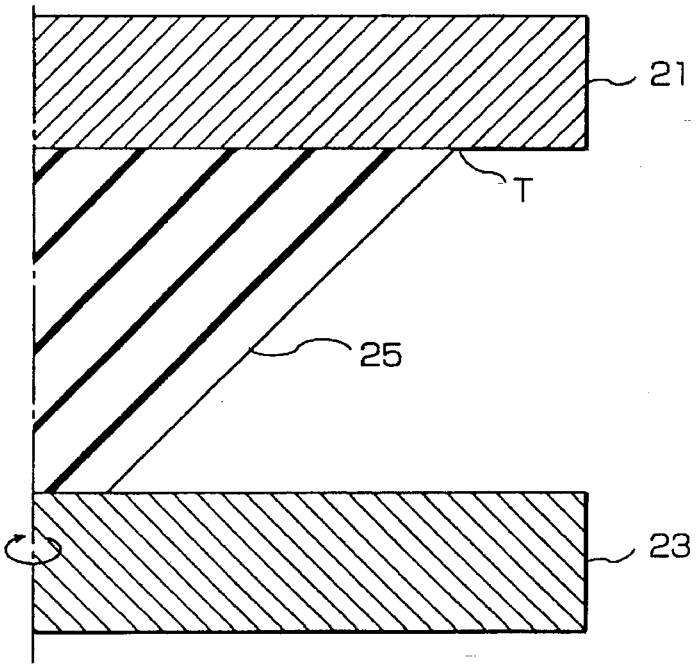
PRIOR ART FIG. 2
FIG. 2 is a partial axial sectional view of a second conventional dielectric spacer in vacuum between a cathode and an anode.

In FIG. 2, a dielectric spacer 25 made of alumina ceramic is devised in order to improve the characteristic of the resistance to voltage. The shape of the dielectric spacer 25 is a truncated cone and has a conical side surface inclined (not perpendicular) to both the surfaces of a cathode 21 and an anode 23.

It is said that this kind of dielectric spacer 25 has the effect of the improved characteristic on account of the following reason.

Generally speaking, when a voltage is supplied between a cathode and an anode with a dielectric spacer used to insulate the cathode and the anode from each other, an electric field is apt to concentrate at a triple contact among an electrode, vacuum and the dielectric spacer, and the triple contact is apt to serve as a point of electron emission. The electrode 21, 23 and the insulator 25 are joined with brazing for instance. When the joint surface is investigated to greater details, there are many concavities and convexities, namely, corrugations which are made of drips of metallizing and congealed brazing filler metal. Very high electric field affects the convexities which have been grown sectionally.

The triple contact among an electrode, vacuum and an insulator is known by the name of a triple junction. Consequently a cathode triple junction T is apt to serve as a point of electron emission.

The intensity of an electric field in vacuum in the vicinity of the cathode triple junction T becomes weaker in the case of the dielectric spacer 25 shown in FIG. 2, because distribution of equipotential surfaces becomes sparser inside the ceramic with high permittivity. Consequently, the electron emission is difficult to occur from the cathode triple junction T.

Even if the electron emission occurs from the cathode triple junction T, electrons are accelerated to the anode 23. Emitted electrons do not collide with the dielectric spacer 25, and do not charge the dielectric spacer 25, because the opening angle on the vacuum side between the dielectric spacer 25 and the cathode 21 is very broad.

Figure 3:
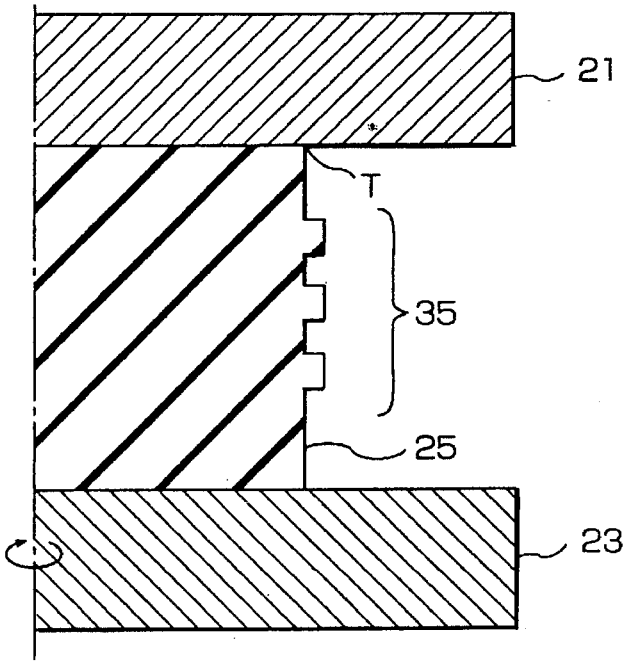
PRIOR ART FIG. 3
FIG. 3 is a partial axial sectional view of a third conventional dielectric spacer in vacuum between a cathode and an anode.

In FIG. 3, a dielectric spacer 25 made of alumina ceramic has a plural concavities and convexities 35 on the surface of it.

But ceramic discharge in vacuum is not clear theoretically up to now, and the most suitable design of the corrugation has not been put into practice. It is said that the longer the flashover distance is, the better the effect of the resistance to voltage is. However, this matter is not clear.

Figure 4:
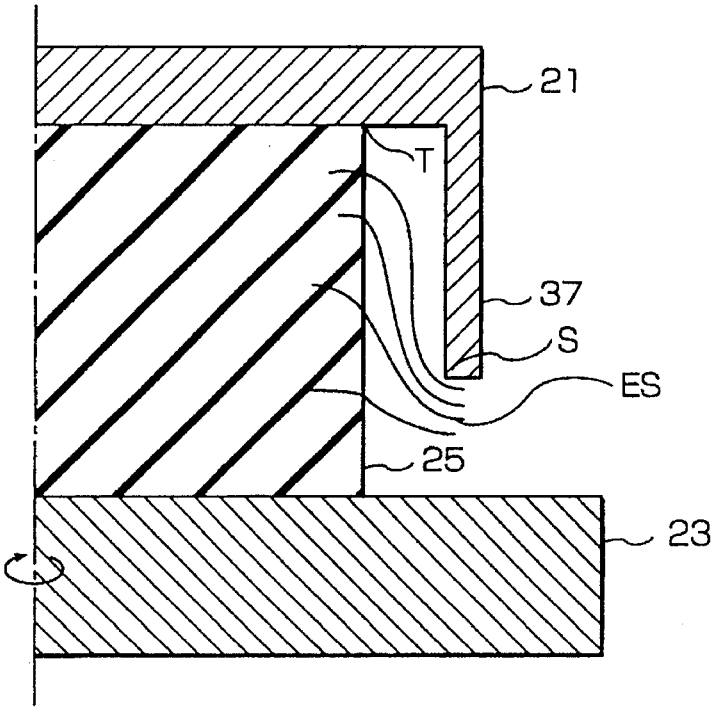
PRIOR ART FIG. 4
FIG. 4 is a partial axial sectional view of a fourth conventional dielectric spacer in vacuum between a cathode and an anode.

In FIG. 4, a dielectric spacer 25 is column-shaped and is made of alumina ceramic. A cathode 21 has corona ring structure. The corona ring structure signifies a structure which elongates the cathode 21 to an anode 23 side along an insulator 25 surface and decreases an electric field of the cathode triple junction T.

The numeral 37 is a corona ring. It is said that the corona ring structure has the effect of the resistance to voltage, because the intensity of the electric field in the cathode triple junction T becomes weaker.

But, in the corona ring structure, equipotential surface ES in vacuum from the side of the dielectric spacer 25 made of ceramic with high permittivity to an edge S of the corona ring 37 becomes denser, because the equipotential surface ES becomes sparser inside the dielectric spacer 25, as shown in FIG. 4. And the intensity of the electric field of the edge S of the corona ring 37 usually becomes very much stronger, because the thickness of the corona ring 37 is thin.

Consequently, a fault of this conventional dielectric spacer is that discharge is apt to occur from the edge S of the corona ring 37 whereat the electric field concentrates.

Figure 5:
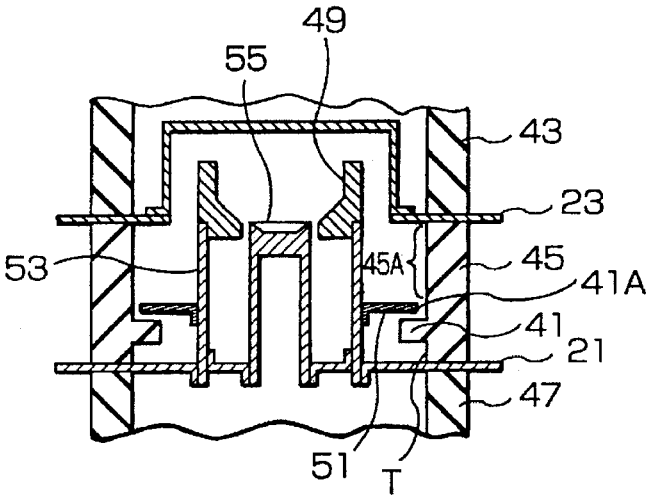
PRIOR ART FIG. 5
FIG. 5 is a axial sectional view of a part of a fifth conventional dielectric spacer in vacuum between a cathode and an anode.

FIG. 5 is a dielectric spacer in vacuum which is described in Japanese Patent Prepublication (A) No. 255,642 of 1992. A cylindrical ceramic 45 has a projection 41. A shield part 51 which is provided to a cathode 21 stands face to face with a surface 41A of the projection 41. There are an anode 23, a cylindrical ceramic 43, a cylindrical ceramic 47, a Wehnelt 49, a Wehnelt holder 53, and a cathode 55, too in this conventional dielectric spacer in vacuum.

As electric potential of the shield part 51 and that of the cathode 21 are the same, the intensity of an electric field in the vicinity of a cathode triple junction T becomes weaker, electron emission from the cathode triple junction T is restrained.

The structure of this conventional dielectric spacer protrudes the cathode to the anode side, and promotes decrease of the electric field in the vicinity of the cathode triple junction. Consequently, this structure is similar to the corona ring structure.

They say the following. As electrons which are emitted from a cathode triple junction have weak energy, secondary emission rate of ceramic is smaller than 1, and the electrons collide with the ceramic surface and go out of existence. But charge effect is not considered.

The electron emission from the cathode triple junction T is difficult to occur in this structure. As the electric field concentrates at the edge of the shield part 51 which protruded in front of the surface 41A of the projection 41, the electron emission begins from the edge of the shield part 51, and a ceramic side 45A is charged to positive.

Consequently, discharge is apt to occur from the edge of the shield part 51 to the anode 23 through the ceramic side 45A, and flashover distance of the cylindrical ceramic 45 becomes shorter on the contrary in this discharge route.

After all, a fault of this conventional dielectric spacer is that discharge is apt to occur from the edge of the electrode same as a simple corona ring structure.

Referring now to FIGS. 6, 7, 8, and 9, the description will proceed to a dielectric spacer 25 according to a first embodiment of this invention.

Figure 6:
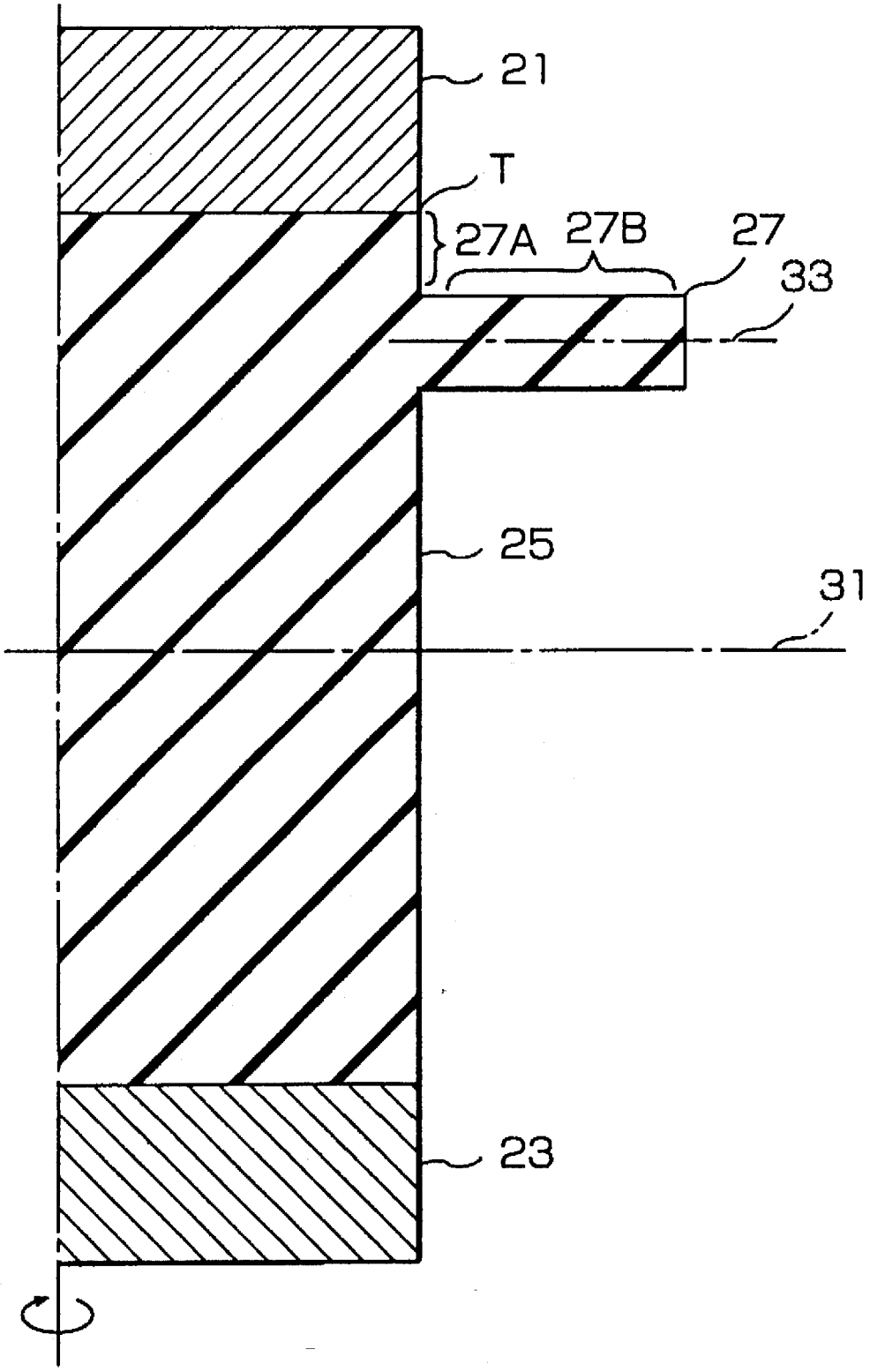
FIG. 6 shows a partial axial sectional view of a dielectric spacer according to a first embodiment of the instant invention together with a cathode and an anode.

In FIG. 6, a dielectric spacer 25 is put between a cathode 21 and an anode 23. The dielectric spacer 25 is made of alumina ceramic, and is able to be made of beryllia ceramic or the other insulator.

The cathode 21 defines a planar plane. The side surface of the dielectric spacer 25 is a cylindrical surface perpendicular to the planar plane.

The dielectric spacer 25 has a projection 27. The center of the thickness of the projection 27 is situated nearer the cathode side than a middle place between the cathode 21 and the anode 23.

A dash-dot line 31 indicates the middle between the cathode 21 and the anode 23, and a dash-dot line 33 indicates the center of the thickness of the projection 27.

The reason why this structure improves the characteristic of the resistance to voltage between the cathode 21 and the anode 23 is as follows.

When electrons which were emitted from a cathode triple junction T among the cathode 21, the anode 23, and vacuum collide with the ceramic surface of the dielectric spacer 25, the electrons charge the ceramic surface in accordance with a curve of secondary emission rate of the ceramic and incident energy of electrons on to the ceramic surface.

Figure 7:
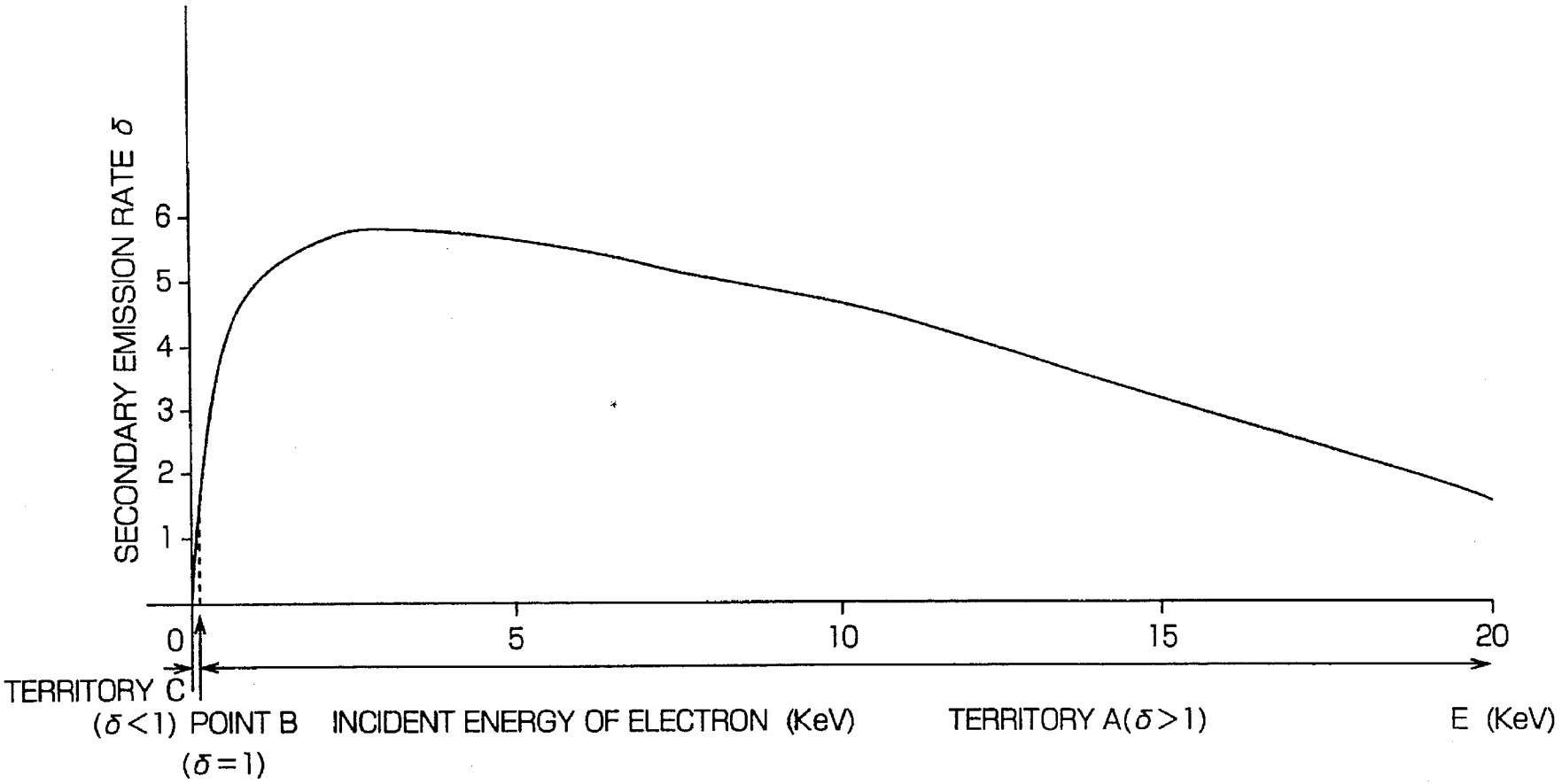
FIG. 7 exemplifies a secondary emission rate of the dielectric spacer illustrated in FIG. 6.

The secondary emission rate is exemplified in FIG. 7.

A horizontal axis indicates the incident energy E of electrons on to the ceramic, and a vertical axis indicates the number δ (per an incident electron) of secondary electrons which are emitted.

The electrons are emitted to various directions in accordance with a certain distribution from the cathode triple junction T. Some electrons collide with a ceramic side 27A between the cathode 21 and the base of the projection 27 after acceleration. Secondary electrons are emitted in accordance with the curve of the secondary emission rate of the ceramic, and charge a ceramic side 27B of the cathode side of the projection 27.

Some electrons which collide with the ceramic side 27A have energy shown in a territory A (the ratio of secondary electron emission $\delta>1$) in FIG. 7 at first. Consequently, the ceramic side 27A is charged to positive.

Positive electrification attracts electrons more, and positive electrification of the ceramic side 27A becomes more larger.

A change of electron orbit on account of the positive electrification becomes very much larger finally. Electrons which were emitted from the cathode triple junction T and secondary electrons which were emitted from the ceramic side 27A collide with the ceramic side 27A before excessive acceleration by the voltage of the anode 23.

Finally, the curve leads to the point B (the secondary emission rate $\delta=1$) in FIG. 7. The incidence and the emission of the electrons to and from the ceramic side 27A keep stabilization at a point B.

In the case of alumina ceramic, electron energy at the point B is approximately 50 eV. On the other hand, secondary electrons from the ceramic side 27A and electrons from the cathode triple junction T collide with the ceramic side 27B. As the electron which is again emitted from the ceramic side 27B of the cathode side of the projection 27 has small energy, and is again brought back to the ceramic side 27B by the voltage of the anode 23. A collision energy of the secondary electrons is approximately equal to the emission energy of the secondary electrons at this moment, and is equal to a few eV.

As the collision energy of the secondary electrons comes into a territory C (the secondary emission rate $\delta<1$) in FIG. 7, the ceramic side 27B of the cathode side of the projection 27 is charged to negative.

This negative electrification decreases the intensity of the electric field in the vicinity of the cathode triple junction T, and restrains the discharge.

Consequently, the nearer to the cathode 21, the projection 27 on the ceramic 25 is, the larger the effect of the discharge restraint is.

And, the longer the length of the projection 27 is, the broader the negative charged area is. Therefore, the longer the projection 27 is, the larger the effect of the discharge restraint is.

The test results of the resistance to voltage are shown in the following Table 1.

Figure 8:
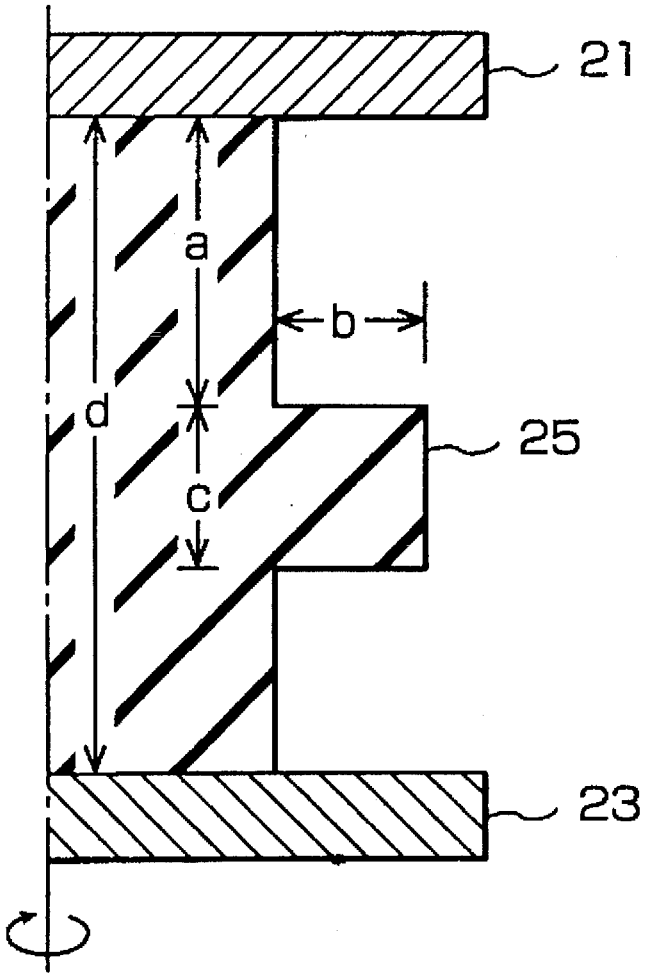
FIG. 8 is a partial axial sectional view of the dielectric spacer and the cathode and the anode illustrated in FIG. 6.

The shapes of the test spacers are shown in FIG. 8

TABLE 1

TEST RESULTS OF RESISTANCE TO VOLTAGE OF CERAMIC WITH PROJECTION

| | a mm | b mm | c mm | d mm | initial discharge voltage (kVDC) |
|---|---|---|---|---|---|
| columnar ceramic | — | — | — | 5 | 16.5 |
| ceramic | 2 | 1.0 | 1 | 5 | 18.5 |
| with | 2 | 1.5 | 1 | 5 | 21 |
| projection | 1 | 1.5 | 1 | 5 | 23 |

a: distance between cathode and cathode side surface of ceramic's projection (mm)
b: length of ceramic's projection (mm)
c: thickness of ceramic's projection (mm)
d: height of ceramic (mm)

In the test, a column-shaped alumina ceramic 25 with the height of 5 mm was put between a cathode 21 and an anode 23, high voltage was applied between the cathode and the anode 23, and the discharge voltage was measured in vacuum.

A few samples with a projection on a ceramic side were prepared as well, and discharge voltage was measured in the different lengths and positions of the samples.

The alumina ceramics were metallized on their surfaces which electrically and mechanically touch both the cathode and the anode, respectively, and touched both the cathode and the anode.

Figure 9:
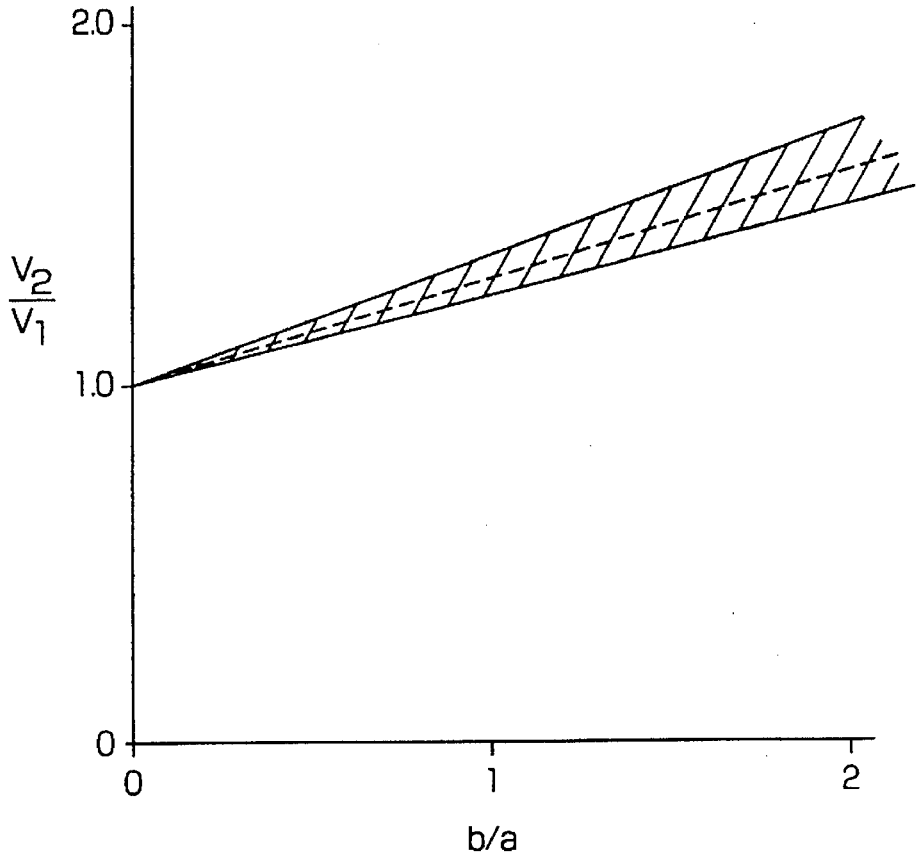
FIG. 9 exemplifies test results of resistance to voltage of the dielectric spacer illustrated in FIG. 6.

In FIG. 9 and the following Table 2, the test results of the resistance to voltage is arranged.

TABLE 2

NORMALIZING TEST RESULTS OF RESISTANCE TO VOLTAGE OF CERAMIC WITH PROJECTION

| shape of ceramic | | normalized initial discharge voltage (note) |
|---|---|---|
| columnar ceramic | | 1 |
| ceramic | 0.5 | 1.121 |
| with projection | 0.75 | 1.273 |
| b/a | 1.5 | 1.394 |

(note) normalization by initial discharge voltage of columnar ceramic

In FIG. 9, the vertical axis indicates the normalized ratio of the initial discharge voltage $V_2$ of the column-shaped ceramic with a projection to the initial discharge voltage $V_1$ of the column-shaped ceramic without any projection, and the horizontal axis indicates the ratio of the protruding length (b) of the projection nearest the cathode to the distance (a) between the cathode and the surface of the cathode side of the projection nearest the cathode.

Judging from FIG. 9, it is obvious that the nearer to the cathode, the projection of the ceramic is, and the longer the length of the projection is, the larger the effect of the discharge restraint is.

The resistance to voltage of the ceramic depends on the states of the ceramic surface, metallization and brazing.

Consequently, unless the column-shaped ceramic with a projection is designed in prospect of the effect to the resistance to voltage of not less than 10% as compared with the simple column-shaped ceramic without any projection, the effect of the resistance to voltage can not be obtained clearly in fact.

The above effect of the resistance to voltage of not less than 10% is gained in the limits of the following formula on the basis of FIG. 9.

When (b) is the protruding length of the projection, and (a) is the distance between the cathode and the surface of the cathode side of the projection, $$(b)/(a) \geqq 0.4$$

Consequently, improvement of the characteristic of the resistance to voltage needs to satisfy the requirements of the above formula in practical use.

In this case, there is not the shield part 51 (see FIG. 5) of the cathode which stands face to face with the anode side of the projection of the ceramic, that is to say, the protruding portion. Therefore the discharge is not given from the protruding portion of the cathode.

It seems as if the shape of the ceramic in FIG. 5 satisfied the requirements of the above formula. Though an actual size of the ceramic is not drawn precisely in this drawing. As FIG. 5 is the merely convenient drawing which was drawn in order to see, understand, and draw with ease, the numerical values in the above formula is not considered.

On the technical level of the time when the dielectric spacer in vacuum shown in FIG. 5 (the patent prepublication cited above) was filed in Japan, there was not entirely even a problem consciousness about the electrification of the ceramic's projection mentioned above.

As the electrons were emitted from the cathode triple junction, the electrification on the ceramic surface was simulated by the Monte Carlo simulation method, and the intensity of the electric field of the cathode triple junction was solved numerically. The above-mentioned matters in this invention became clear for the first time.

The phenomena became clear for the first time, because both theoretical calculation and experiment were made, and their results were in agreement.

As the electrification of the protruding portion 27 of the ceramic which was described in the explanation of this invention was not explained before this invention, an analogy on the basis of the patent prepublication cited above was impossible.

Figure 10:
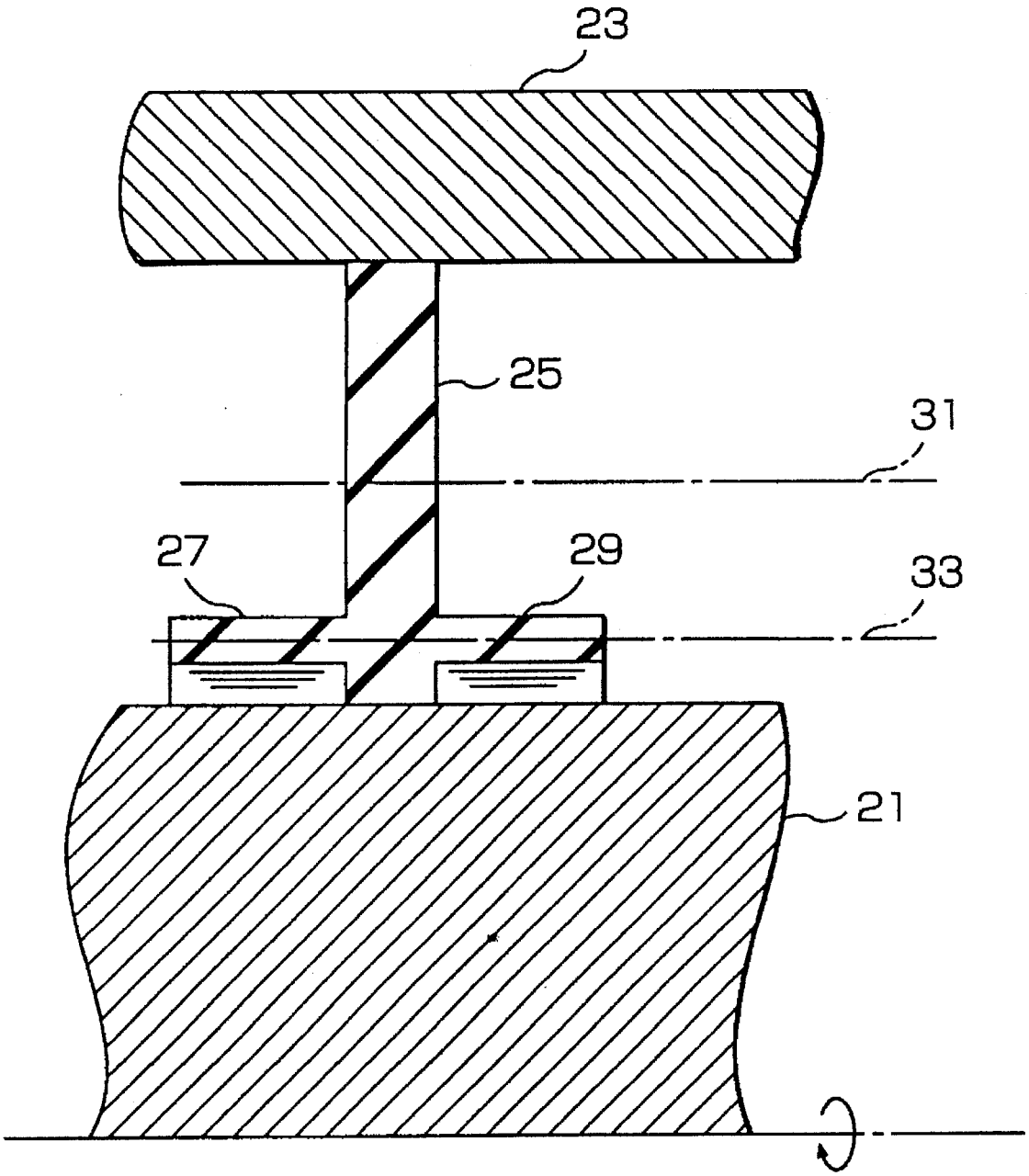
FIG. 10 shows a partial axial sectional view of a dielectric spacer according to a second embodiment of this invention together with a cathode and an anode partially illustrated in section along an axis of rotation indicated by a dash-dot line with a small circular along indicative rotation.

Referring FIG. 10, a circular ring-shaped dielectric spacer 25 according to a second embodiment of this invention maintains a rod-shaped cathode 21 and a pipe-shaped anode 23, and has projections 27, 29 on both a side surface and the other side surface of it. The side surface is parallel to the other side surface. The center of the thickness of the projections 27, 29 is situated nearer the cathode 21 than a middle between the cathode 21 and the anode 23. The dielectric spacer 25 is made of alumina ceramic or beryllia ceramic.

The cathode 21 has an axis and both side surfaces of the dielectric spacer 25 is perpendicular to the axis. The projections 27, 29 extend perpendicularly from both side surfaces of the dielectric spacer 25. The projections 27, 29 have coplanar inner and outer surfaces which define the cathode 21 and the anode 23 ends.

Both the side surfaces of the dielectric spacer 25 face to vacuum, and the dielectric spacer 25 has the projections 27, 29 on account of possibility of discharge at both side surfaces of it.

A dash-dot line 31 indicates the middle between the cathode 21 and the anode 23, and a dash-dot line 33 indicates the center of the thickness of the projection 27.

The dielectric spacer 25 has the same effect of the resistance to voltage of the dielectric spacer 25 of the first embodiment of this invention.

Figure 11:
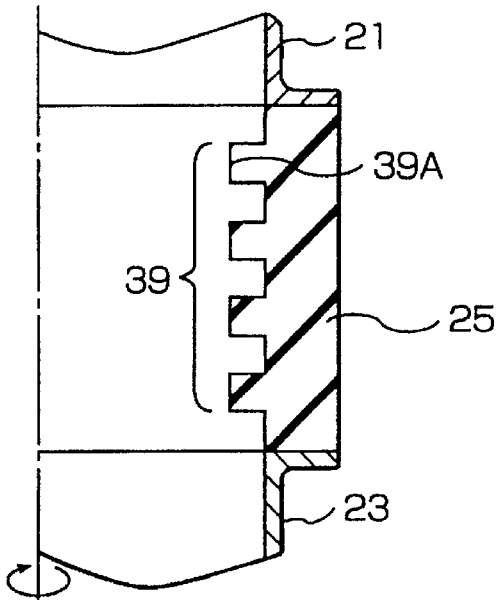
FIG. 11 is a partial axial sectional view of a dielectric spacer according to a third embodiment of this invention.

Referring to FIG. 11, attention will be directed to a dielectric spacer 25 according to a third embodiment of this invention. Like in FIG. 6, a cathode 21 defines a planar plane upwardly of the figure.

The dielectric spacer 25 is interposed between the cathode 21 and an anode 23 and has a hollow cylindrical shape having an inner and an outer cylindrical surface. The dielectric spacer 25 is made either of alumina ceramic or of beryllia ceramic with the outer cylindrical surface molded in general. The inner cylindrical surface serves as the above-mentioned spacer surface and is perpendicular to the planar plane to enclose a sealed and evacuated space in cooperation with the cathode 21 and the anode 23. The outer cylindrical surface is in contact with the atmosphere.

A plurality of disk-shaped projections 39 are upwardly extended perpendicularly of the spacer side surface to provide altogether a corrugation 39. One of the projections 39 is the projection 27 described in conjunction with FIG. 6 that is nearest to the cathode 21 and is designated by a reference numeral 39A. This one of the projections 39 should have the cathode distance relative to the planar plane and the length of projection which satisfy the 0.4 or greater ratio described before. The number of the projections 39 either in total or with exception of the projection 39A is immaterial. Similar to the dielectric spacers 25 described in conjunction with FIGS. 6 through 9 and FIG. 10, the projection 39A removes the adverse effects.

Figure 12:
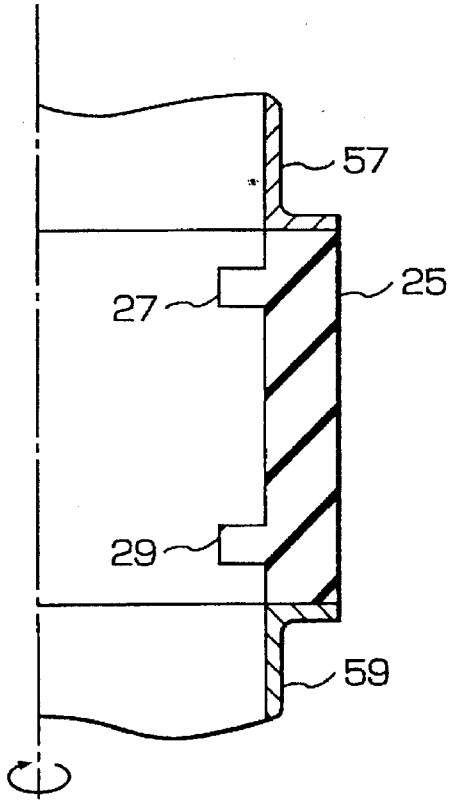
FIG. 12 is a partial axial sectional view of a dielectric spacer according to a fourth embodiment of this invention.

Referring to FIG. 12, a dielectric spacer 25 according to a fourth embodiment of this invention is shaped cylindrically, and two AC electrodes 57 and 59 are disposed at the upside and the downside of the dielectric spacer 25, respectively. The outside of the dielectric spacer 23 is molded and faces to the atmosphere. The inside of the dielectric spacer 25 maintains the vacuum.

As an AC voltage is applied between the two AC electrodes 57 and 59, either of them can become a cathode.

As the outside of the dielectric spacer 25 is molded in order to hold the resistance of voltage, the subject is a countermeasure to the inside surface of the dielectric spacer 25.

Consequently, the dielectric spacer 25 has a projection 27 and 29 (two in all) for the resistance to voltage in the vicinity of both the AC electrodes 57 and 59, respectively.

As either of the AC electrodes 57 and 59 can become a cathode, the electrode in the vicinity of the projection is regarded as the cathode, and the above formula is able to be applied between the projection and the cathode.

Even if an AC voltage is applied on this dielectric spacer, discharge on the ceramic surface is restrained, and the characteristic of the resistance to voltage is improved.

The dielectric spacer 25 is made of alumina ceramic or beryllia ceramic.

What is claimed is:

1. A dielectric spacer for use in vacuum between a cathode and an anode with avoidance of surface flashover resulting from a voltage supplied between said cathode and said anode, said dielectric spacer comprising:

a side spacer surface and a projection protruded perpendicularly of said side spacer surface;

said projection having a length of projection from said side spacer surface, a cathode side end having a cathode distance relative to said cathode, an anode side end, and a thickness having a center plane between said cathode side end and said anode side end and nearer to said cathode than to said anode, a ratio of said length of projection to said cathode distance being not less than 0.4;

said cathode being free of surfaces facing said anode side end.

2. A dielectric spacer as claimed in claim 1, said cathode defining a planar plane, wherein said side surface is a cylindrical surface perpendicular to said planar plane, said cathode distance being between said cathode end and said planar plane.

3. A dielectric spacer as claimed in claim 1, said cathode having a rod shape having an axis, said anode having a pipe shape, said side surface being a first side surface, wherein said dielectric spacer has a circular ring shape having said first side surface perpendicular to said axis and a second side surface parallel to said first side surface, said projection comprising first and second cylindrical projections extending perpendicularly from said first and said second side surfaces to have coplanar inner and outer surfaces defining said cathode and said anode ends.

4. A dielectric spacer as claimed in claim 1, wherein said dielectric spacer has a corrugation structure.

5. A dielectric spacer for use in vacuum between first and second electrodes with avoidance of surface flashover resulting from an AC voltage supplied between said first and said second electrodes, said dielectric spacer having a side spacer surface and first and second projections protruded perpendicularly of said side spacer surface, wherein each of said first and said second projections has a length of projection from said side spacer surface, a thickness having a center plane nearer to one of said first and said second electrodes than to the other of said first and said second electrodes, and a side projection surface parallel to said center plane to have a projection distance relative to said one of first and second electrodes, a ratio of said length of projection to said projection distance being not less than 0.4.

* * * * *